United States Patent [19]

Yewer, Jr. et al.

[11] Patent Number: 4,782,535

[45] Date of Patent: Nov. 8, 1988

[54] BELT

[75] Inventors: Edward H. Yewer, Jr., 6251 N. Hwy. 83, Hartland, Wis. 53029; Clifford L. Cook, Boise, Id.

[73] Assignee: Edward H. Yewer, Hartland, Wis.

[21] Appl. No.: 124,003

[22] Filed: Nov. 23, 1987

[51] Int. Cl.[4] ..... A41F 9/00

[52] U.S. Cl. ..... 2/321; 2/338

[58] Field of Search ..... 2/321, 338, 336, 340, 2/DIG. 6

[56] References Cited

U.S. PATENT DOCUMENTS

| | | | |
|---|---|---|---|
| 3,063,058 | 11/1962 | Vollet | 2/338 |
| 3,112,494 | 12/1963 | Hardie | 2/338 X |
| 3,153,246 | 10/1964 | Silverman | 2/338 |
| 3,295,529 | 1/1967 | Corrigall et al. | 2/338 X |
| 3,544,408 | 12/1970 | Loew | 2/338 X |
| 3,873,403 | 3/1975 | Edelman | 2/338 X |
| 4,348,774 | 9/1982 | Woodson | 2/338 X |
| 4,501,028 | 2/1985 | Gottschall | 2/338 |
| 4,685,668 | 8/1987 | Newlin, Jr. | 2/338 X |

*Primary Examiner*—H. Hampton Hunter

*Attorney, Agent, or Firm*—John C. Cooper, III; Fred Wiviott; C. Thomas Sylke

[57] ABSTRACT

A belt is disclosed which may be used for support, comfort and/or decoration, and has particular application in weight lifting, kidney support or other protection and which is of a construction utilizing a plurality of layers, one of which is of an elastically yieldingly compressible and shape-restoring material.

5 Claims, 1 Drawing Sheet

BELT

BACKGROUND OF THE INVENTION

1. Field of the Invention

This invention pertains to a belt or binder, which may be used for a variety of applications, such as for weight lifting and other exercises, for motorcycle or truck driving support belts, and for belts for tool holsters, the latter being used by carpenters, electricians and utility linemen. The belts may also be used as "designer" belts and clothing accessories.

2. Description of Related Art

Prior belts or binders have ordinarily been fabricated from relatively stiff and hard materials, such as leather. Although, over a lengthy "break-in" period the leather will tend to soften and conform to the particular configuration of the individual wearing the belt, the leather material is relatively heavy and unyielding, and may become an additional burden when used to support tools or the like. Also, prior belts were often designed for one individual size and were relatively restricted in use to a particular application.

There are other belts and binders available for recovery and rehabilitation use, such as those prescribed by medical practitioners. These have generally been fabricated of materials which do not conform to body contours, are uncomfortable to wear and are very noticeable to the public, causing fashion conscious patients to intentionally avoid using the prescribed supports.

Gun holsters, per se, have been made with a sandwich-type construction as disclosed in U.S. Pat. No. 4,485,947 granted to Clifton L. Cook.

A general object of the present invention is to provide a belt or binder, having a contracted or relaxed state memory adapted to conform to an individual and to receive various degrees of stress in localized areas depending upon the bone structure and other configuration of the individual wearing the belt.

It is another object of the present invention to provide a belt achieving the requirements of the prior art belts, but minimizing the objectionable concerns of past belts.

It is a further object of the present invention to provide a belt or binder capable of being used in athletic events, such as weight lifting, weight throwing and other actions where support is required, and in application such as so-called "kidney belts" for motorcycle and truck operators, utility linemen belts for supporting tool holsters and fashion belts.

Still another object of the invention is the provision of a belt which may be prescribed by medical practitioners for support during convalescence or rehabilitation from surgery or injury.

A still further object of the invention is to provide a belt which is lightweight and relatively comfortable to wear and which is readily adaptable for choice of fabric colors, decorative trim and use of "designer" buckles and other accessories.

According to a preferred embodiment of the invention, a belt or binder is proposed which is characterized by a sandwich-type construction including three layers. An intermediate or central layer takes the form of a yieldably firm elastomer, such as a closed-cell foam, which functions to provide contracted-shape memory, allowing the belt to deform to accommodate various applications. Inner and outer layers take the form of durable, wear-resistance fabrics which are preferably stretchable to prevent creasing and also to conform to irregular surface patterns of the body-conforming, memory-forming intermediate layer. The belt may further include an external ribbon or edging providing a stitched-on bead to cover the exposed edges of the three layers or webs. Further, the supporting belt may include any of a variety of additional closure or webbing means, releasably fastened by buckles, snaps and closures, e.g. of "Velcro" type material, either alone or in combination with a buckle to secure the free end of a belt or web utilized along with the buckle.

The three layers are preferably surface-bonded or "Flame" combined to one another using any of a variety of conventional adhesives or by the use of heat.

The proposed belt or binder offers all of the advantage discussed above and substantially avoids the aforementioned drawbacks of prior belts. Each of the three layers function to provide a particular advantage, and the collection of layers acts to furnish an extremely reliable and versatile belt having less weight and being less cumbersome than prior belts. Relaxed-shaped memory is provided by the central or intermediate layer to accommodate the individualistic contour of the person wearing the belt. The belt does not take on a specific memory, but may provide the desired support with change of clothing, loss or gain of weight, and with variations of weight that might be supported, e.g. tools in a depending holster.

These and other objects and advantages which are attained by the invention will become more fully apparent as the description which now follows is read in conjunction with the accompanying drawings.

DETAILED DESCRIPTION OF THE INVENTION

Figure 1:
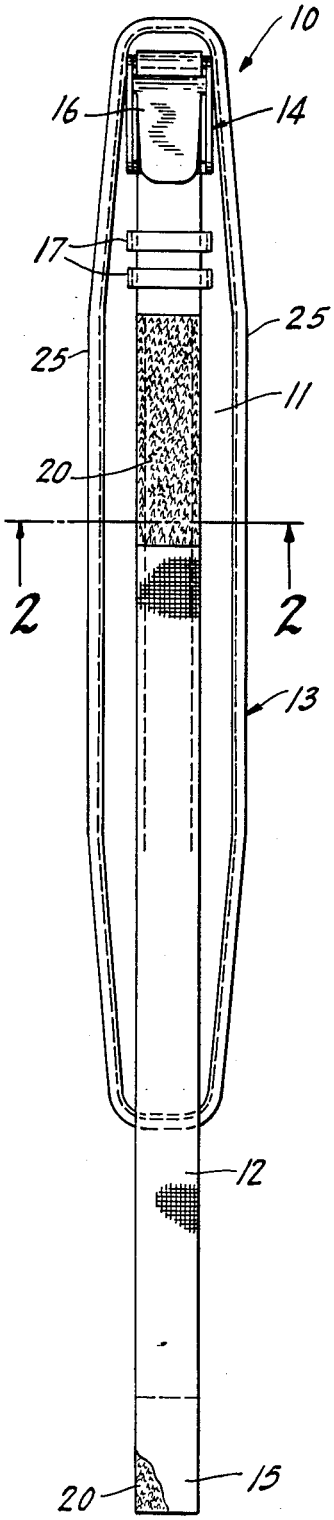
FIG. 1 is a front elevational view of a belt constructed in accordance with the present invention.

Referring to the drawings, indicated generally at 10 is a supporting belt or binder constructed in accordance with the invention. The particular construction shown here relates to a support belt having particular application in weight lifting or similar exercises, such as weight lifting on loading docks, or for the general protection of kidneys and other organs often affected by vibration and road hazards occurring during riding motorcycles or operating trucks or truck-trailers. That is, the belt or binder 10 may be used as shown in the FIG. 1 embodiment without straps, loops, indents or other means for supporting depending items such as tool holsters or the like.

In the present case, just as in conventional leather weight or exercise belts, it is preferable to provide a belt with its widest width occurring in the proximity of the center of the belt 10 and tapering to a lesser width as the material extends laterally from the center.

The view of FIG. 1 illustrates the belt 10 having an external layer 11 of stretchable or expandable fabric, preferably of about 15% Lycra and 85% nylon. This combination provides a very desirable bright colored material for external appearance. LYCRA is a trademark of I.E. Dupont de Nemours.

A supplemental strap webbing 12 of approximately two inches in width made of nylon is coextensive of the belt body 13 and may extend beyond the length of the body 13 as required. The webbing 12 is sewn to the body intermediate its ends and is provided with adjustable fastening end portions 14 and 15. The end portion 14 includes a cam-type buckle 16 arranged to receive the opposite fastening portion 15, which is adapted to be threaded through both the buckle 16 and a slidable belt loop 17 surrounding the webbing 12. The free end 15 may also include one portion 20 engageable with a cooperating portion 21 to provide a conventional "Velcro" type fastener for securing any excess material of the extending free end portion 15.

Figure 2:
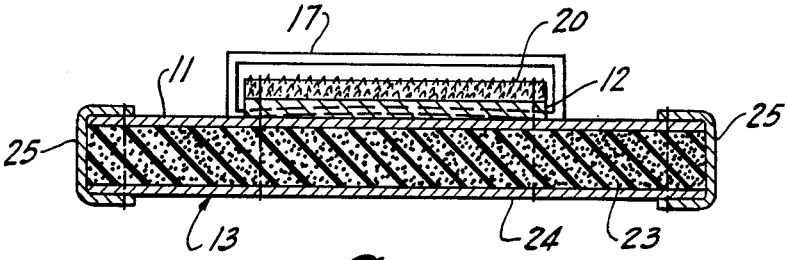
FIG. 2 is a cross-sectional view taken along lines 2—2 of FIG. 1.

With reference to the cross-sectional view of FIG. 2, it will be noted that the body 13 of the belt 10 includes the external or outer fabric layer 11, an internal central or intermediate layer 23 and an inner fabric layer 24. The inner and outer layers 24 and 11 are preferably manufactured from a stretchable or expandable fabric, also preferably of "Lycra". In this case, the inner Lycra material layer 24 is woven or fabricated to provide a "brushed tricote" of "fuzzy" texture. An example for a shiny outer Lycra material 11 is woven by Milliken Company and bears catalog No. 5 or S/2539. The intermediate or central layer 23 constitutes a memory web, and is preferably formed from a yieldable foam elastomer having excellent retentive memory characteristics. It is preferred to fabricate the intermediate layer 23 of a closed-cell polyethylene foam made by VOLTEK Division of Sekisui American Corporation of Lawrence, Massachusetts. It is preferably a 4 pound "A" grade ¼ inch thick, 100% polyethylene foam known as "Volara". A softer blend may also be used. In that case the polyethylene is suitably mixed with ethyl vinyl acetate. This blend has particular application in designer type belts of FIG. 4. The foam material of intermediate layer 23 is radiation crosslinked, as opposed to chemical crosslinking.

The respective confronting faces in the interfaces between the layers 11, 23, and 24 are bonded by any suitable flexible adhesive or by heat. One acceptable method is known as "Flame Combining". This is supplied under this identifier by United Foam Plastics Corporation of Georgetown, Mass. The combining is a four pass type where a first layer is a urethane film laminated to the polyethylene foam. The three bonded webs or layers 11, 23 and 24 have their exposed edges bound by a stitched-on bead of any suitable material, such as nylon ribbon shown at 25. Stitching of this ribbon 25 is done in a conventional manner utilizing heavy-duty nylon thread.

Figure 3:
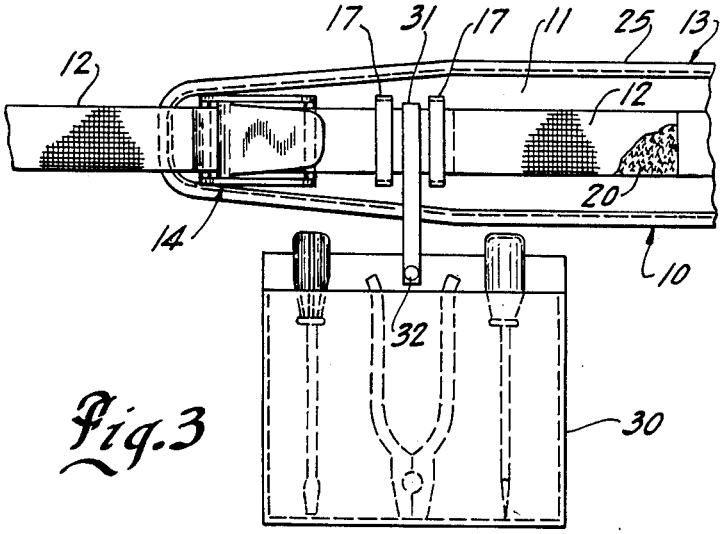
FIG. 3 is a fragmentary front elevational view illustrating a modification of the belt of FIG. 1 to permit support of a depending object, such as a tool holder.

With reference to FIG. 3, the support belt or binder 10 may be utilized to support a depending object, such as a tool holster 30. In such case, the tool holster 30 may be supported from a leather holster loop 31 surrounding the webbing 12. The ends may be joined in a rivet 32. An additional belt loop 17 may be used and fastened to the webbing 12 to prevent sidewise movement of the holster loop 31.

Figure 4:
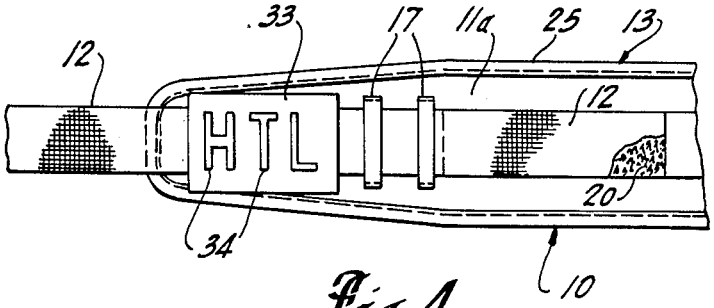
FIG. 4 is a fragmentary elevational view of the belt of FIG. 1 modified to be used with a decorative fastening buckle.

FIG. 4 is illustrative of a "decorator" type belt 10 of substantially identical belt construction described in connection with FIG. 1. Here a "fancy" decorator buckle 33 may be selected by a designer to enhance the appearance of the belt 10, and various colored fabrics used for the external layer 11 and/or edging or bead 25 may be chosen to provide the desired "effect". The "designer" belt 10 of FIG. 4, in itself, provides novel decorative and ornate characteristics. But further, under the teachings of this invention, the belt 10 of FIG. 4 may be used as a belt binder to provide required support, such as that provided by the embodiment of FIG. 1. In such case, there is provided both decorative and functional improvements for those needing extra back or other support recommended by doctors, chiropractors and for rehabilitation in workman's compensation situations. The conforming qualities of the memory type material are quite suitable for therapeutic applications, and the selection of the outer layer 11*a* fabric may be chosen to provide a more desirable and decorative appearance than conventional belts, supports, and other items chosen from a material having a conventional, and relatively undesirable, "clinical" appearance. Belts 10 of the FIG. 4 embodiment encourage usage by otherwise reluctant patients.

As can be appreciated now from the description which has just been given, and from the illustrations in the drawings, the belt or binder proposed by the present invention offers all of the advantages ascribed earlier, and avoids all of the major deficiencies that characterized prior art conventional belts or binders.

What is claimed is:

1. A support belt comprising:

(a) an inner layer of stretchable fabric;

(b) an intermediate layer, substantially coextensive in size and shape with said inner layer and joined thereto, of an elastically yieldingly compressible and shape-restoring foam material having a thickness greater than that of said inner layer;

(c) an outer layer of stretchable fabric substantially coextensive in shape and size with said intermediate layer and joined thereto;

(d) said three layers being in substantial overlying registration with respective confronting surfaces being heat combined with one another to provide a sandwich combination and configured to define said support belt; and (e) adjustable fastener means for joining the opposite ends of said belt.

2. The belt of claim 1, wherein the intermediate layer is of a closed-cell foam elastomer material.

3. The belt of claim 1, wherein the exposed margins of said sandwiched layer combination are enclosed by an overlying marginal fabric bead stitched thereto.

4. The belt of claim 1, wherein said fastening means includes an elongated web at least coextensive with and fastened to said belt and adapted to be secured to a releasable buckle.

5. The belt of claim 2, wherein the closed-cell foam elastomer material includes a heat combining, heat sensitive film deposited on opposite surfaces thereof.

* * * * *